US006851359B2

(12) United States Patent
Dumoulin

(10) Patent No.: US 6,851,359 B2
(45) Date of Patent: Feb. 8, 2005

(54) OFFSET PRINTING METHOD AND DEVICE

(75) Inventor: Michel Dumoulin, Epernay (FR)

(73) Assignee: Sparflex, Epernay (FR)

( * ) Notice: Subject to any disclaimer, the term of this patent is extended or adjusted under 35 U.S.C. 154(b) by 0 days.

(21) Appl. No.: 10/464,739

(22) Filed: Jun. 19, 2003

(65) Prior Publication Data

US 2004/0069167 A1 Apr. 15, 2004

Related U.S. Application Data

(63) Continuation-in-part of application No. 09/954,161, filed on Sep. 18, 2001, now abandoned.

(30) Foreign Application Priority Data

Jun. 22, 2001 (FR) ..... 01 08285

(51) Int. Cl.[7] ..... B41F 9/00; B41F 29/00; B41F 35/14

(52) U.S. Cl. ..... 101/142; 101/487; 101/486; 101/488; 101/217

(58) Field of Search ..... 101/142, 486, 101/487, 488, 216, 217, 349

(56) References Cited

U.S. PATENT DOCUMENTS 4,183,298 A * 1/1980 Cappel et al. ..... 101/348
5,272,971 A * 12/1993 Fredericks ..... 101/136
5,309,838 A * 5/1994 Kurz ..... 101/480
5,452,657 A * 9/1995 Kurz ..... 101/216
5,471,927 A * 12/1995 Frank et al. ..... 101/216
5,588,360 A 12/1996 Kurz
5,606,914 A 3/1997 Borgardt
5,611,278 A * 3/1997 Garner et al. ..... 101/349.1
5,694,848 A * 12/1997 Palmatier ..... 101/219
5,749,295 A 5/1998 Kurz
5,784,957 A 7/1998 Rau et al.
5,881,643 A 3/1999 Silvestre
6,209,456 B1 4/2001 Murray et al.

* cited by examiner

*Primary Examiner*—Andrew H. Hirshfeld
*Assistant Examiner*—Marissa Ferguson
(74) *Attorney, Agent, or Firm*—Young & Thompson

(57) ABSTRACT

This invention relates to an offset printing method in which the picture to be printed is formed on a plate-holder-cylinder (3), the said picture is transferred onto a blanket (4) carried by a blanket-holder-cylinder (5), then transferred onto a paper compressed between the blanket (4) and a back pressure cylinder (7). The temperature T3 of the blanket-holder-cylinder (5) is regulated.

The invention also relates to an offset printing device comprising an inking unit (1), a plate-holder-cylinder (3), a blanket-holder-cylinder (5), a backpressure cylinder (7). It comprises means (8) for regulating the temperature T3 of the blanket-holder-cylinder (5).

11 Claims, 4 Drawing Sheets

OFFSET PRINTING METHOD AND DEVICE

BACKGROUND OF THE INVENTION

The invention relates to an improvement for offset printing methods and devices.

DESCRIPTION OF THE RELATED ART

Offset printing techniques are well known now and they enable to obtain good quality printing whose accuracy is highly appreciated.

The devices implemented in offset printing usually comprise an inking unit that applies ink on a cylinder carrying the plate bearing the pattern to be reproduced. This roll is called a plate-holder-cylinder.

This plate-holder-cylinder is in contact with a cylinder that carries a blanket (blanket-holder-cylinder) which is itself in contact with the paper that is inserted between this blanket-holder-cylinder, more precisely the blanket itself, and a backpressure cylinder.

Numerous attempts have been made until now to improve the quality and more particularly the printing accuracy obtained with such devices.

Thus, it has been noticed that the temperature conditions under which printing is carried out, are significant, which can be easily understood since the rheological properties of the inks depend on the said conditions to a vast extent.

Thus, it has already been suggested to regulate the temperature of the inking unit and of the plate-holder-cylinder as well.

There exist temperature regulation systems of different types to stabilise the ink temperature. Most systems consist in cooling down the inking unit by blowing air or by circulating a coolant liquid inside the inking plates. As regards the plate-holder cylinder, we seek to cool down or regulate its temperature by circulating a coolant liquid.

These different devices generally enable to print while avoiding warping phenomena. But because of the necessary decrease in temperature, these devices induce poor quality of the distribution of ink on the inking plates and a significant risk of tearing the superficial layer of the paper away. As regards the printing quality, the rendering obtained is not optimal since the solid colour zones are not thinly homogeneous and exhibit fleecy aspects. Moreover, because of temporary stoppages of the printing press, of the modification of its production speed and of the variations in environment, tone alterations in the raster portions of the picture may appear during printing by reason of temperature and viscosity changes of the ink during transfer on paper.

SUMMARY OF THE INVENTION

The purpose of this invention consists therefore in improving the stability and the quality of the print obtained still further.

Surprisingly, it has been noticed that regulating the temperature of the blanket-holder-cylinder, which until now had been considered as impossible or pointless, enabled to reach the required result.

To this effect, the invention relates to an offset printing method in which:

- the picture to be printed is placed on a plate-holder-cylinder,
- the said picture is transferred onto a blanket carried by a blanket-holder-cylinder, then

- transferred onto a paper compressed between the blanket and a backpressure cylinder.

According to the invention, the temperature T3 of the blanket-holder-cylinder is regulated.

This invention also relates to the features that will be put in evidence during the following description and that should be considered individually or in all their technically possible combinations:

- the respective temperatures T1 of the inking unit and T2 of the blanket-holder-cylinder are regulated,
- the temperature value T2 is smaller than T1 as well as T3.

Advantageously:

- the temperature T1 ranges between 25 and 35° C.,
- the temperature T2 ranges between 16 and 25° C.,
- the temperature T3 ranges between 28 and 35° C.

Preferably:

- the temperature T1 is in the order of 28° C.,
- the temperature T2 is in the order of 22° C.,
- the temperature T3 is in the order of 33° C.

the method is a waterless offset printing method.

The invention also relates to an offset printing device:

- an inking unit,
- a plate-holder-cylinder,
- a blanket-holder-cylinder,
- a backpressure cylinder.

According to the invention, the device comprises means for regulating the temperature T3 of the blanket-holder-cylinder and means for regulating the respective temperatures T1 of the inking unit and T2 of the plate-holder-cylinder.

The means for regulating the temperatures each comprise an electrical heater and circulation of the coolant liquid placed at least partially inside the corresponding cylinder.

BRIEF DESCRIPTION OF THE DRAWINGS

A particular embodiment of the invention will now be described with reference to the drawings.

DESCRIPTION OF THE PREFERRED EMBODIMENTS

Figure 1:
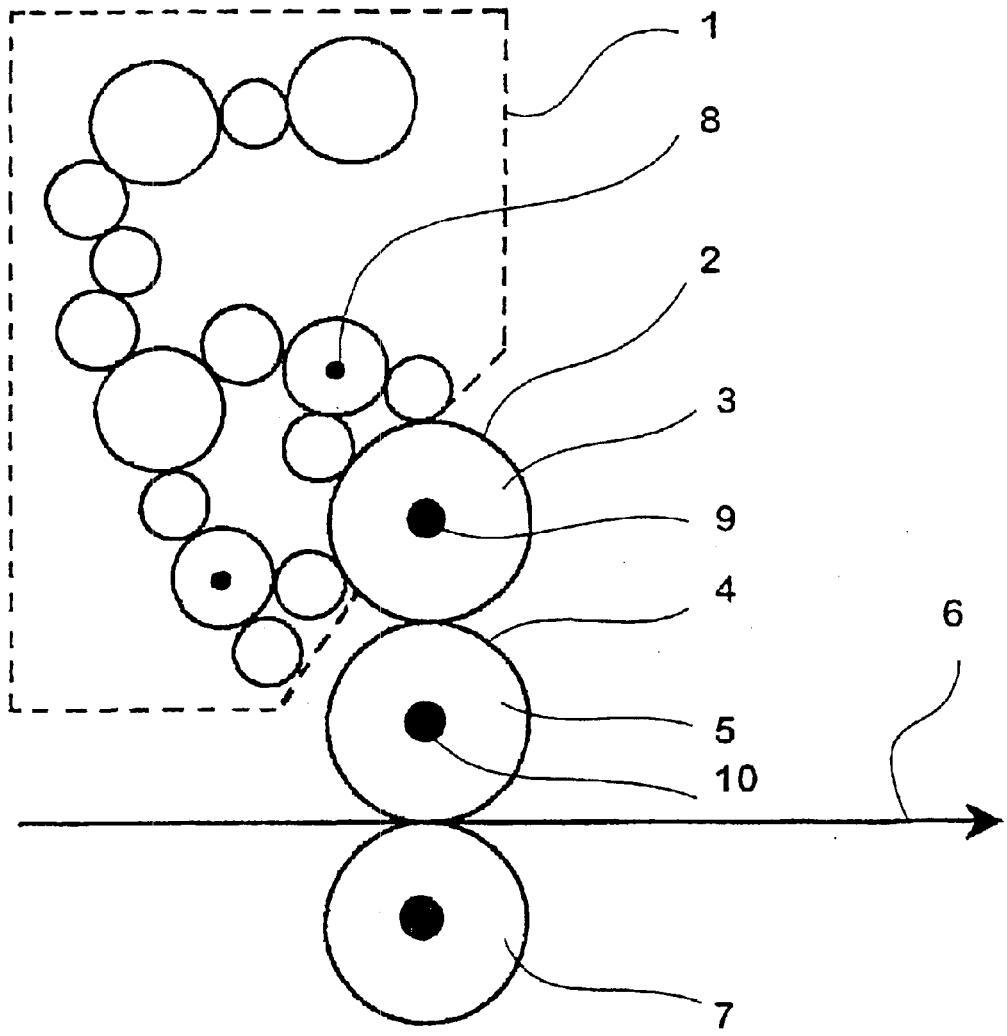
FIG. 1 shows the different cylinders of a printing unit.

FIG. 1 represents an offset printing device. An inking unit 1 is placed in contact with the plate 2 supported by the plate-holder-cylinder 3.

This plate 2 is placed in contact with the blanket 4 carried by the blanket-holder-cylinder 5. The paper 6 is pressed by the backpressure cylinder 7 onto the blanket 4.

This type of device can be used as well for the implementation of the offset conventional method or for the implementation of the particular waterless method known under the terminology 'waterless offset'.

For both methods, according to the invention, the machines are fitted with a temperature regulation unit of the blanket-holder-cylinder 5.

So far, such an arrangement had not been foreseen, whereas such a regulation had been considered as difficult to be implemented, probably by reason of the properties of the blanket 4, its fragility and particularly of its insulating properties.

This regulation has improved the printing quality. The solid colour zones as well as the raster points of the print obtained have a homogeneous aspect over the whole printing width. It is possible to print solid colours without tearing the layer of the paper away.

In a preferred embodiment, a second regulation unit 9 of the inking unit is provided as well as a third regulation unit 10 of the plate-holder-cylinder 3.

By using appropriate temperature for the inking unit 1 and the plate-holder cylinder 3, it is possible to maximise the printing quality with respect to the nature of the ink and of paper used. For the same adjustment of the ink flow rate, the tone value of the raster portions of the printed picture can be made constant.

The invention is particularly useful in the case of its application to a waterless printing method. It is known that the control of this method is even trickier than the control of the conventional offset method.

The specificity of the waterless offset lies in the type of plate and ink used: the non-printing zones of the plate consist of a layer of silicon that pushes the ink away, formulated especially to that effect. The temperature is an influent parameter in the waterless offset. By reason of this increase in temperature caused by the friction loads in the inking unit, the viscosity of the ink is reduced and the ink tends to cover the non-printing zones of the plate (warping phenomenon).

The printing quality obtained is therefore not as good.

The results obtained thanks to the invention show that it is possible to regulate the temperature of the inking unit 1 to a relatively low level, which contributes to homogeneous distribution of the ink in the rolls. It is thus that the temperature of the inking unit is regulated between 25 and 35° C. and preferably around 28° C.

The temperature of the plate 2 is then maintained between 16 and 25° C., allowing for rather high viscosity of the ink and preventing any warping phenomenon as the picture is formed.

The temperature of the blanket-holder-cylinder 5 and of the blanket 4 itself is maintained between 28 and 35° C., preferably around 33° C., it is therefore greater than the temperature of the plate-holder-cylinder 3 and of the plate 2 itself. That temperature is further optimized according to the rheologic features of the ink. It is generally maintained between 33 and 35° C., sometimes somewhat higher. This enables to diminish the viscosity of the ink and ensures homogenisation of the inking film on the blanket 4, then onto the paper, facilitating the cutting of the inking film during the second transfer of the picture.

Thus, owing to the regulation of the plate-holder-cylinder provided with a plate, the latter is maintained at a relatively lower temperature, whereas the blanket is maintained at a relatively higher temperature. For maintaining those temperatures, the blanket-holder-cylinder has to be heated sometimes. The temperature of the blanket is precisely determined according to the ink. It may be adapted to the specific rheologic features of each ink, especially to its viscosity which is directly linked to the filling of the raster points.

The active regulation according to the present invention can be started even before printing is started. Thus the printing conditions will be optimal right from the beginning of printing and the resulting quality will be constant.

Figure 2:
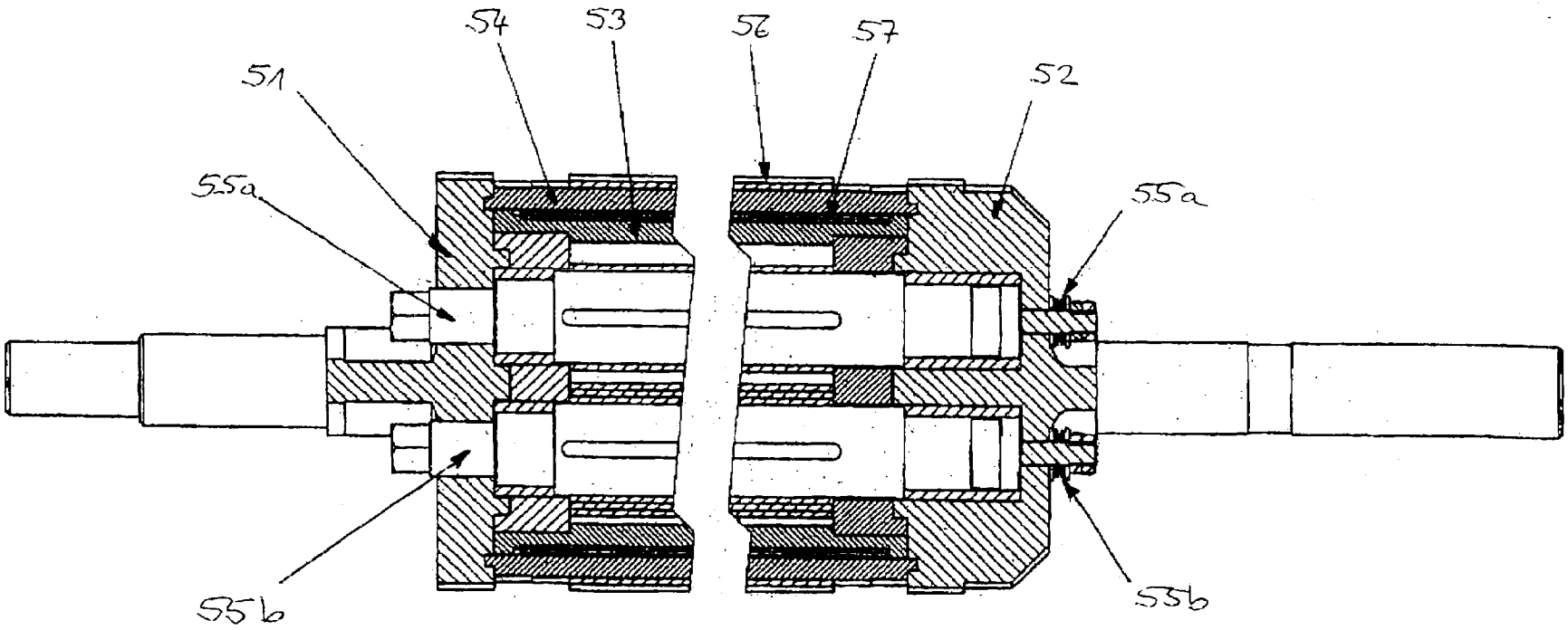
FIGS. 2 and 3 show longitudinal sections of a blanket-holder-cylinder according to the invention.
Figure 3:
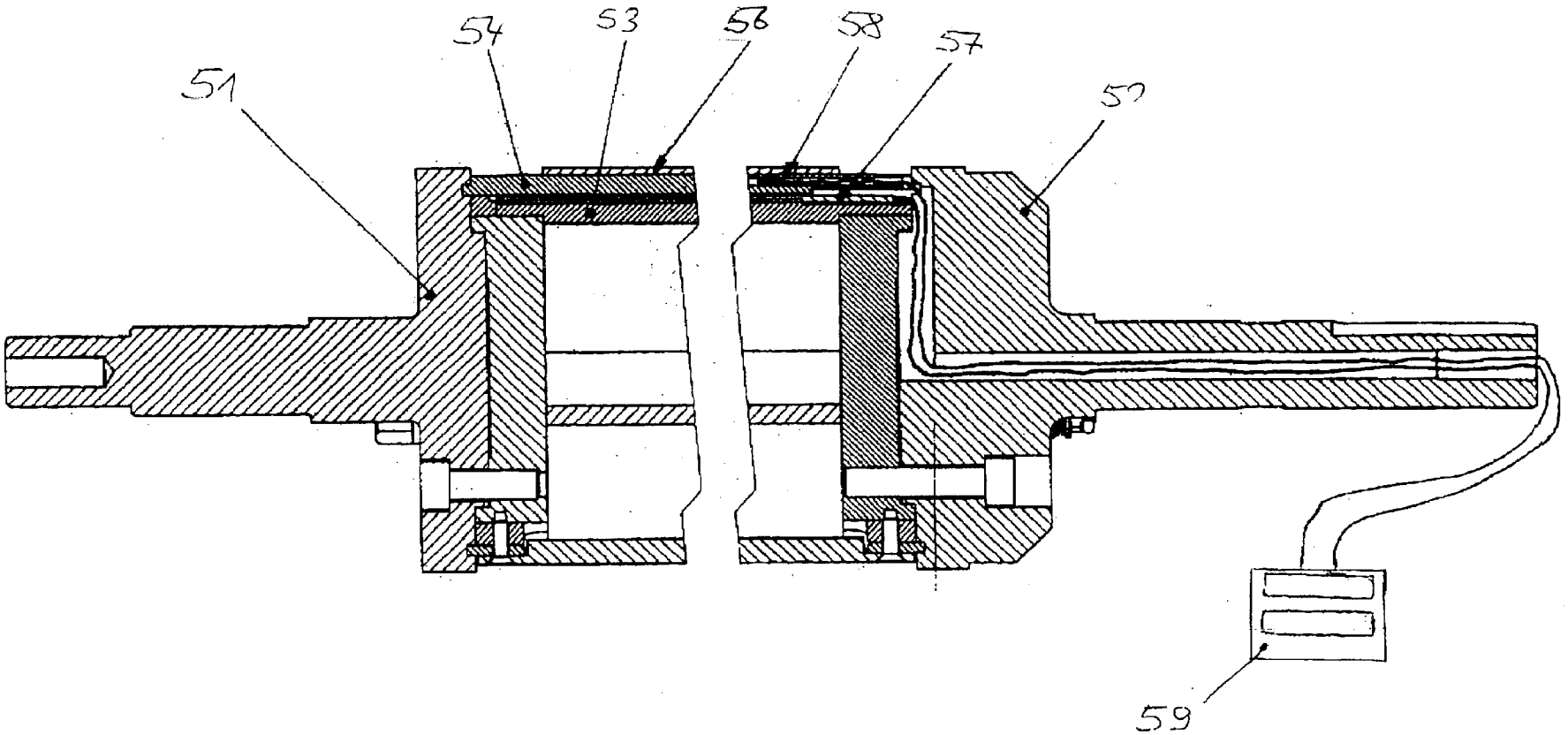
Figure 4:
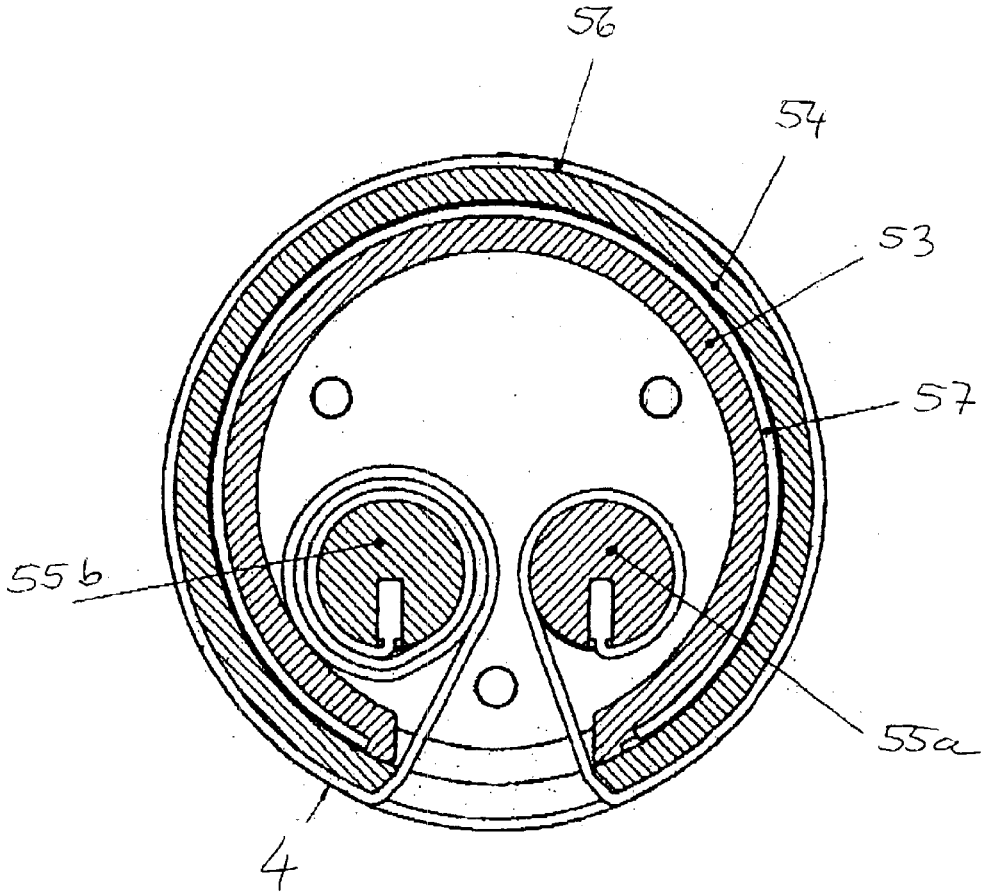
FIG. 4 shows a cross section of the cylinder of FIGS. 2 and 3.

The heated blanket-holder-cylinder as shown on FIGS. 2 to 4 is composed of dismountable elements having predetermined functions. These elements enable to obtain good geometrical, mechanical and thermal distribution in order to ensure homogeneous transfer of the image to be reproduced on the medium to be printed.

The blanket-holder-cylinder 5 comprises a priming cord 51 of the cylinder, a cord 52 on the output side of the cables of a heating resistor 57 and of a temperature probe 58, a resistor holder inner envelope 53, a blanket holder outer envelope 54, blanket gripping cylinders 55*a*, 55*b*, a blanket 56, an electric heating resistor 57, a temperature probe 58, and a PID-type temperature control system 59.

These constitutive elements of the blanket-holder cylinder have the following functions:

The priming cord 51 is the driving element of the cylinder because of its link with a main shaft or an electric driving motor. Its link can be direct via a coupling or indirect by a toothed gear train.

A collar, of diameter perfectly calibrated to be in contact with the collar of the upper cylinder, enables to maintain the accurate dimension between the blanket and the printing plate as well as the compression of the blanket.

The roller bearings are mounted on said element.

The cable output side cord 52 is the element which lets through the electric cables for the heating resistor and the temperature probe.

A collar, of diameter perfectly calibrated to be in contact with the collar of the upper cylinder, enables to maintain the accurate dimension between the blanket and the printing plate as well as the compression of the blanket.

The roller bearings are mounted on said element.

The inner envelope 53 is the linking element between the driving cord 51 and the cable output side cord 52, with perfect concentricity of both cords.

A housing on the generator set and following a given angle corresponding to the heating zone enable placement of the heating resistor.

An opening over the length of the envelope enables placing and letting through both gripping cylinders 55*a*, 55*b* of the blanket.

The outer envelope 54 is the cylindrical element perfectly calibrated in diameter and concentric to both cords 51 and 52.

This element enables thermal transfer of the heating resistor to the blanket with good distribution on the appropriate zone.

The gripping cylinders 55*a*, 55*b* of the blanket enable the rotation displacement of the blanket for adjusting the format of the blanket and enable to switch on the blanket on the outer envelope 52. A friction adjustable braking system enables to maintain and to stretch the blanket during the rotation displacement for adjusting the format of the blanket.

The gripping mode described here is a particular case corresponding to the printing machines with variable printing format on a fixed printing cylinder. But the gripping mode of the blanket being independent of the heating system, the gripping cylinders can be replaced with any other device enabling to switch on the blanket, by a gripping system properly speaking or if the blanket is in the form of a sleeve.

The blanket 56 is the rubber element which transfers the printing of the plate holder cylinder to the medium to be printed.

The electric heating resistor 57 is the heating element placed between the outer envelope 54 and the inner envelope 53. This resistor transfers the heat to the peripheral zone of the outer envelope 54 to heat the blanket. The electric resistor is linked to the temperature regulation system 59.

The probe 58 is the element which enables to control the temperature on the outer envelope 54. The probe is linked to the temperature control system 59.

The temperature control system 59 is a PID-type electronic regulator which, linked to a temperature probe 58 and a heating resistor 57 enables to ensure constant temperature of the cylinder, according to the reference required.

That system has the following advantages. Such an electric resistor system, trapped between both half-shells of the cylinder, enables uniform distribution of the heat over the whole surface of the cylinder and therefore over the whole surface of the blanket, in direct contact with this heated surface.

This system also ensures high temperature stability for several reasons: on the one hand, the electric resistor is in a closed environment which avoids heat losses, on the other hand the probe is implanted directly in the matter to be regulated, hence the measurement is not disturbed by the external environment and consequently, the regulation is also more stable.

What is claimed is:

1. An offset printing method comprising the steps of:

regulating a temperature T1 of an inking unit (1);

forming a picture to be printed on a plate-holder-cylinder (3) while regulating a temperature T2 of the plate-holder-cylinder;

transferring the picture onto a blanket (4) carried by a blanket-holder-cylinder (5) while regulating a temperature T3 of the blanket-holder-cylinder (5); and after said transferring step 1 transferring the picture onto a paper compressed between the blanket (4) and a back pressure cylinder (7), wherein the temperature value T2 is smaller than both of temperature T1 and temperature T3 and that a means for regulating (10) the temperature T3 of the blanket-holder-cylinder (5) uses an electrical heater, said electrical heater is a resistor (57) placed between a blanket-holder outer envelope (54) and resistor-holder inner envelope (53), both said envelopes are disposed concentrically between a priming cord (51) and a cable side cord (52) and said cable is in connection with the resistor and a temperature probe (58) controlling the temperature on the outer envelope (54).

2. An offset printing method according to claim 1, wherein the means for regulating the temperatures use means for circulating a coolant liquid placed at least partially inside the corresponding cylinder.

3. An offset printing method according to claim 2, wherein the means for regulating (9) the temperature T2 of the plate-holder-cylinder uses an electrical heater.

4. An offset printing method according to claim 2, wherein the means for regulating the temperature T1 of the inking unit (1) uses an electrical heater.

5. An offset printing method according to claim 1, wherein, the temperature T1 ranges between 25 and 35° C., the temperature T2 ranges between 16 and 25° C., and the temperature T3 ranges between 28 and 35° C.

6. An offset printing method according to claim 5, wherein, the temperature T1 is in the order of 28° C., the temperature T2 is in the order of 22° C., and the temperature T3 is in the order of 30° C.

7. An offset printing method according to claim 1, wherein the method is a waterless offset printing method.

8. An offset printing device comprising:

an inking unit (1), the temperature T1 of said inking unit being regulated;

a plate-holder-cylinder (3), a picture to be printed being formed on said plate-holder-cylinder, the temperature T2 of the plate-holder-cylinder being regulated;

a blanket-holder-cylinder (5), the said picture being transferred onto a blanket (4) carried by said blanket-holder-cylinder, the temperature T3 of the blanket-holder-cylinder being regulated; and a back pressure cylinder (7), the picture being then transferred onto a paper compressed between the blanket and said back pressure cylinder, wherein the temperature value T2 is smaller than temperature T1 as well as temperature T3, the means for regulating (10) the temperature T3 of the blanket-holder-cylinder (5) comprises an electrical heater, said electrical heater is a resistor (57) placed between a blanket-holder outer envelope (54) and resistor-holder inner envelope (53), both envelopes are disposed concentrically between a priming cord (51) and a cable side cord (52), and said cable is in connection with the resistor and a temperature probe (58) controlling the temperature on the outer envelope (54).

9. An offset printing device accord to claim 8, wherein the means for regulating the temperatures comprise means for circulating a coolant liquid placed at least partially inside the corresponding cylinder.

10. An offset printing device according to claim 9, wherein the means for regulating (9) the temperature T2 of the plate-holder-cylinder comprise an electrical heater.

11. An offset printing device according to claim 9, wherein the means for regulating the temperature T1 of the inking unit (1) comprise an electrical heater.

* * * * *